United States Patent [19]

Rey-Coquais

[11] 4,292,462

[45] Sep. 29, 1981

[54] LIQUID DIELECTRIC COMPOSITIONS COMPRISING BROMOCHLOROBENZENE/POLYCHLOROBENZENE ADMIXTURES

[75] Inventor: Bruno Rey-Coquais, Lyons, France

[73] Assignee: Rhone-Poulenc Industries, Paris, France

[21] Appl. No.: 131,488

[22] Filed: Mar. 18, 1980

[30] Foreign Application Priority Data

Mar. 21, 1979 [FR] France ..... 79 07713

[51] Int. Cl.[3] ..... H01B 3/24

[52] U.S. Cl. ..... 174/17 LF; 252/570; 252/579

[58] Field of Search ..... 252/66; 260/650 R; 361/317, 318; 336/94, 58; 174/17 LF

[56] References Cited

U.S. PATENT DOCUMENTS

| | | | |
|---|---|---|---|
| 2,257,903 | 10/1941 | Oreisbach | 252/66 X |
| 4,097,913 | 6/1978 | Lapp et al. | 252/66 X |
| 4,119,555 | 10/1978 | Jay | 252/66 |
| 4,177,156 | 12/1979 | Jay et al. | 252/66 |

*Primary Examiner*—Harris A. Pitlick

*Attorney, Agent, or Firm*—Burns, Doane, Swecker & Mathis

[57] ABSTRACT

Liquid, non-flammable dielectric compositions especially adapted as insulators/coolants for transformers and the like, are comprised of an admixture of [i] a bromochlorobenzene and [ii] a polychlorobenzene, and, optionally, [iii] a diluent therefor.

36 Claims, No Drawings

LIQUID DIELECTRIC COMPOSITIONS COMPRISING BROMOCHLOROBENZENE/POLYCHLOROBENZENE ADMIXTURES

BACKGROUND OF THE INVENTION

1. Field of the Invention

The present invention relates to novel, liquid, non-flammable dielectric compositions, and more especially, to such dielectric compositions well suited as insulators/coolants for electrical transformers and the like.

2. Description of the Prior Art

It is well known to this art that the dielectric liquids utilized in electrical apparatus, and especially in transformers, perform a dual function. On the one hand, they serve as insulating liquids, and in this respect they must satisfy certain requirements concerning their electrical properties, in particular their dielectric strength and coefficient of dissipation. On the other hand, they concurrently serve as a cooling agent for the apparatus, in which case they must ensure excellent removal or dissipation of the heat generated during its operation. This latter function can only be successfully fulfilled if the agent employed possesses a sufficiently low viscosity, under the very variable conditions of use of such apparatus, for the liquid to readily dissipate the heat evolved. It is also art recognized that transformers, for example, may be required to function at extremely low external temperatures, for example, temperatures which are below 0° C. and even as low as −40° C. It is therefore important that, at these extreme temperatures, the dielectric remains a liquid having adequate fluidity and, moreover, does not give rise to complete crystallization. Consequently, same must remain liquid, or at least partially liquid, so that the crystals which would develop during prolonged periods at low temperatures would always be impregnated and surrounded by liquid, which makes it possible to prevent air from penetrating into the working parts of the transformer.

In addition to these properties, the dielectric liquids for certain types of apparatus are also required to be non-flammable. In fact, under the operating conditions of such apparatus (for example, transformers), a destruction of the dielectric can occur upon the formation of an electric arc which is indeed quite powerful. This breakdown arc decomposes the liquid or solid dielectrics and can ignite the liquid and/or the gases evolved, whether these are decomposition products of the dielectric or of the vapors thereof. It is thus important that the dielectric liquid and its vapors, or the decomposition gases produced in the event of a malfunction in the apparatus, do not ignite. In general, this ignition resistance is assessed in terms of the flash point of the liquid in question and of the results of certain fire resistance tests.

Numerous liquid dielectrics, possessing, to a greater or lesser extent, all of the properties enumerated above, have been proposed, especially for transformers. Among such dielectrics, the "Askarels" have proven to be the most satisfactory and are the most widely used. Same are products resulting from the chlorination of biphenyl or terphenyl and containing from 3 to 7 chlorine atoms; they are most frequently employed in the form of admixtures with one another or with other chlorinated aromatic hydrocarbons, in particular, the trichlorobenzenes and tetrachlorobenzenes. Despite their demonstrated value, these particular dielectrics exhibit the serious disadvantage that they cannot be degraded by biochemical means and cannot easily be degraded by chemical means. This stability of polychlorobiphenyls presents serious hazards from an environmental pollution standpoint, with the result that there is a recognized need and demand for products which are naturally short-lived because they are chemically or biochemically degradable. Products which possess the technical properties referred to above, coupled with good degradability, have not hitherto, been available industrially.

Compare generally U.S. Pat. Nos. 4,019,996, 4,108,789, 4,119,555, 4,142,983 and 4,177,156.

SUMMARY OF THE INVENTION

It has now been found that certain compositions are especially well suited as insulator/coolant dielectric liquids for transformers, which dielectrics:

(1) remain totally or partially liquid at low operating temperatures, and, more particularly, remain thus at temperatures which can be as low as −30° C.;

(2) are non-flammable;

(3) have low viscosity under the typical conditions of use, and in particular, have a viscosity of less than 15 cP at 60° C.;

(4) have excellent dielectric properties; and (5) are degradable in the event of environmental pollution.

More specifically, above and other objects of the present invention are attained by providing certain novel liquid dielectric compositions, characterized in that same comprise:

(i) a bromochlorobenzene fraction, and (ii) a polychlorobenzene fraction consisting of at least one trichlorobenzene and/or at least one tetrachlorobenzene.

The present invention also features dielectric compositions of the above type, in which, moreover, the polychlorobenzene fraction (ii) contains one or more dichlorobenzenes in addition to the trichlorobenzene and/or the tetrachlorobenzene.

The present invention additionally relates to dielectric compositions of the above type, which comprise, in addition to the fractions (i) and (ii) a diluent (iii) selected from the group comprising the monoalkylbiphenyls or polyalkylbiphenyls, the monoalkylterphenyls or polyalkylterphenyls, biphenyl and terphenyls and which are at least partially hydrogenated, monoalkylbenzenes or polyalkylbenzenes, arylalkanes, phthalic acid esters and either the natural or synthetic aliphatic oils. The function of the diluent (iii) is to somewhat modify the overall properties of the subject dielectric compositions in order to render same more suitable for their intended uses. The addition of the diluent, for example, makes it possible to vary the permittivity, the viscosity and the crystallization point.

DETAILED DESCRIPTION OF THE INVENTION

More particularly, the bromochlorobenzene fraction (i) of the compositions according to the invention comprises at least one bromochlorobenzene having the structural formula:

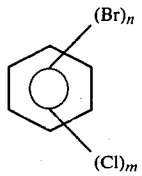

(I)

in which m and n, which are identical or different, represent integers equal to 1 or 2, the sum m+n being equal to at most 3.

Exemplary of the bromochlorobenzenes of the foregoing formula (I) are 1-bromo-2-chlorobenzene, 1-bromo-3-chlorobenzene, 1-bromo-4-chlorobenzene, 1,2-dibromo-3-chlorobenzene, 1,2-dibromo-4-chlorobenzene, 1,3-dibromo-2-chlorobenzene, 1,3-dibromo-5-chlorobenzene, 1,3-dibromo-4-chlorobenzene, 2-bromo-1,3-dichlorobenzene, 2- bromo-1,4-dichlorobenzene, 4-bromo-1,2-dichlorobenzene, 1-bromo-3,5-dichlorobenzene and 1-bromo-2,4-dichlorobenzene.

The aforesaid bromochlorobenzenes can be used either singly or in any admixture thereof, in widely varying proportions which are not critical. Thus, suitable admixtures of the isomeric monobromomonochlorobenzenes are envisaged, for example, 1-bromo-2-chlorobenzene/1-bromo-3-chlorobenzene/1-bromo-4-chlorobenzene mixtures, or mixtures of isomeric monobromodichlorobenzenes.

The trichlorobenzenes and tetrachlorobenzenes incorporated as a component of the polychlorobenzene fraction (ii) in the dielectric liquids according to the present invention, are known products having melting points above 17° C. In spite of their good dielectric properties and their nonflammability, these chlorobenzenes have not been used in and of themselves as dielectrics because of their excessively high crystallization points. 1,2,4-trichlorobenzene and 1,2,3,4-tetrachlorobenzene have been used as additives in dielectrics, or in customary cooling liquids, such as the polychlorobiphenyls, in order to lower the solidification point thereof [compare Ullman, *Encyclopadie der Technischen Chemie* (Ullman's Encyclopedia of Chemical Technology), Volume 5, page 468 (1954); Kirk-Othmer, *Encyclopedia of Chemical Technology,* Volume 5, page 265 (1964); and German Pat. No. 687,712]. The use of mixtures of trichlorobenzenes as dielectric liquids has also been disclosed, however, these compositions, which principally comprise 1,2,3-trichlorobenzene and 1,2,4-trichlorobenzene, and small amounts of other chlorobenzenes (dichlorobenzenes and tetrachlorobenzenes), still have excessively high crystallization points which are too high for use in transformers. Thus, the eutectic mixture of 1,2,3-trichlorobenzene and 1,2,4-trichlorobenzene, which contains 34% and 66% of the two isomers, respectively, has a crystallization point of +1.5° C. [compare Ullman, *Encyclopadie der Technischen Chemie* (Ullman's Encyclopedia of Chemical Technology), Volume 9, page 500 (1957)].

1,2,3-Trichlorobenzene, 1,2,4-trichlorobenzene and 1,2,3,4-tetrachlorobenzene are preferred from among the trichlorobenzenes and tetrachlorobenzenes which can be used as components of the polychlorobenzene fraction (ii) in the compositions described above. These compounds can be used either singly or in any admixture with each other; in the latter case, the proportions of each of the constituents are not critical and can vary over wide limits. For example, in these mixtures, each compound can represent from 1 to 99% of the weight of the total weight of the mixtures. However, for practical reasons, the eutectic mixtures 1,2,3-trichlorobenzene/1,2,4-trichlorobenzene and 1,2,3-trichlorobenzene/1,2,4-trichlorobenzene/1,2,3,4-tetrachlorobenzene, and eutectic mixtures formed from tetrachlorobenzene with each of the abovementioned trichlorobenzenes, are preferably used.

In addition to the trichlorobenzenes and/or tetrachlorobenzenes, the polychlorobenzene fraction (ii) can contain up to 25% by weight, relative to these compounds, of one or more of the dichlorobenzenes, namely, o-dichlorobenzene, p-dichlorobenzene, or ortho-/meta-dichlorobenzene, ortho-/para-dichlorobenzene or ortho-/meta-/para-dichlorobenzene mixtures, and in which the proportion of each isomer is not critical and too can vary over wide limits. In general, the amount of the dichlorobenzenes in the fraction (ii) varies from 2 to 25% by weight of the trichlorobenzenes and/or the tetrachlorobenzenes, preferably from 5 to 25% by weight.

The proportion of the fractions (i) and (ii) in the compositions according to the invention are advantageously between 5 and 35% by weight of the bromochlorobenzene fraction (i) and between 95 and 65% by weight of the polychlorobenzene fraction (ii), preferably between 5 and 20% by weight of the fraction (i) and between 95 and 80% by weight of the fraction (ii).

The alkylaromatic hydrocarbons which can be used as a diluent in the dielectric compositions of the invention correspond to those of the structural formulae:

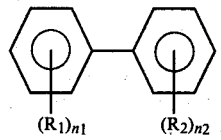

(II)

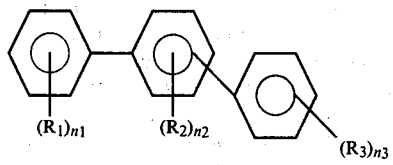

(III)

in which $R_1$, $R_2$ and $R_3$ represent linear or branched chain alkyl radicals which are identical or different and contain from 1 to 5 carbon atoms, preferably from 2 to 4 carbon atoms, and $n_1$, $n_2$ and $n_3$, which are identical or different, represent 0 or an integer between 1 and 3, with the restriction that at least one of the indices $n_1$, $n_2$ and $n_3$ is equal to at least 1 and that the sum $n_1+n_2$ is equal to at most 5 and the sum $n_1+n_2+n_3$ is equal to at most 4.

Exemplary of the aforesaid radicals $R_1$, $R_2$ and $R_3$ are methyl, ethyl, n-propyl, isopropyl, n-butyl, isobutyl, t-butyl and n-pentyl radicals. $R_1$, $R_2$ and $R_3$ preferably represent ethyl, propyl and butyl radicals and, even more preferably, represent isopropyl and t-butyl radicals.

The alkylbiphenyls and alkylterphenyls employed in the liquid dielectrics according to the invention are known products which are obtained by alkylating biphenyl and terphenyls utilizing customary alkylating agents, such as alkyl halides, aliphatic olefins containing from 1 to 5 carbon atoms, or alkanols, in the presence of the typical catalysts for Friedel-Crafts reactions. Because of their valuable physical and dielectric properties, such compounds are used as cooling liquids and it has even been proposed to use certain of such compounds as dielectrics themselves [compare U.S. Pat. No. 2,837,724]. However, because of their flammability, the alkylbiphenyls and alkylterphenyls are not used, as a practical matter.

Depending upon their physical state at low temperatures, the alkylbiphenyls and alkylterphenyls can be used in pure form or in the form of mixtures of isomers and/or of products having different degrees of alkylation, obtained during their preparation. The crude mixtures resulting from the alkylation of biphenyl and of terphenyls, which mixtures, if appropriate can contain the unconverted starting material biphenyl and terphenyl in addition to such reaction products, are preferably used. In all cases, the degree of alkylation of the mixture, represented by the number of alkyl groups per molecule, is preferably at least 0.5 and more preferably is at least 1.

Examples of the alkylbiphenyls and alkylterphenyls which, depending on the particular case, are used either singly or in any admixture with each other, are, without limitation: 2-ethylbiphenyl, 4-ethylbiphenyl, 4,4'-diethylbiphenyl, triethylbiphenyls, 2-propylbiphenyl, 4-propylbiphenyl, 4-isopropylbiphenyl, 3,3'-dipropylbiphenyl, 4,4'-dipropylbiphenyl, 3,3',5,5'-tetraisopropylbiphenyl, 2-n- butylbiphenyl, 3-sec.-butylbiphenyl, 2-t-butylbiphenyl, 2,2'-di-t-butylbiphenyl, 2,4,6-tri-t-butylbiphenyl, 4'-isopropyl-meta-terphenyl, 4'-butyl-meta-terphenyl, diisopropylmeta-terphenyl, 4,4''-diethyl-meta-terphenyl, triisopropyl-meta-terphenyl, 4-isopropyl-ortho-terphenyl, 4-butyl-orthoterphenyl, diisopropyl-para-terphenyl, triisopropyl-paraterphenyl and 4,4'-dibutyl-para-terphenyl.

The reaction products resulting from the alkylation of mixtures of 2 or 3 isomeric terphenyls can also be used without departing from the scope of the present invention. In particular, mixtures resulting from the isopropylation and the t-butylation of mixtures of two or three isomeric terphenyls or of biphenyl can be used.

Another group of compounds which can be used as a diluent in the compositions according to the invention comprises biphenyl or terphenyls which are "at least partially hydrogenated". This expression is intended to connote those reaction mixtures obtained by hydrogenation, in accordance with known processes, of biphenyl or of terphenyls, either singly or in admixture with one another and/or with biphenyl (for example, mixtures of ortho-terphenyl and/or metaterphenyl and/or para-terphenyl can by hydrogenated), which hydrogenation mixtures too can contain unhydrogenated biphenyl or terphenyls; these mixtures thus display very diverse degrees of hydrogenation. The term degree of hydrogenation denotes the fraction, relative to 100, of the number of hydrogen atoms theoretically required to ensure the complete hydrogenation of the aromatic nuclei of the biphenyl or terphenyls. In practice, products having a degree of hydrogenation of at least 10% and at most 40% are used.

Alkylbenzenes which can be used as a diluent for the dielectric compositions according to the invention advantageously contain from 1 to 3 alkyl groups, each of which has from 9 to 15 carbon atoms, such as nonyl, decyl, dodecyl and pentadecyl radicals. Other alkylbenzenes which may be employed, however, include ethylbenzene and isopropylbenzene. In particular, the alkylbenzenes obtained, for example, by alkylating benzene with olefins or with alkyl halides can be used.

A further group of useful diluents comprises the arylalkanes, in particular, the diphenylalkanes or polyphenylalkanes in which the aliphatic radical contains from 1 to 10 carbon atoms. 1,1-diphenylethane, 1,2-diphenylethane, 1,2-diphenylpropane, xylylphenylethane and ethylated diphenylmethane are particularly worthwhile. Alkylbenzenes and arylalkanes having a boiling point above 300° C. are preferably employed.

Yet another group of compounds which can be employed as diluents in the compositions of the invention comprises the phthalic acid esters having the structural formula:

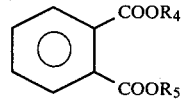

(IV)

in which $R_4$ and $R_5$, which are identical or different, represent linear or branched alkyl radicals having from 3 to 10 carbon atoms, such as n-propyl, isopropyl, n-butyl, isobutyl, t-butyl, n-pentyl, 2-methylbutyl, 2,2-dimethylpropyl, 2-ethylbutyl, n-hexyl, 2-ethylpentyl, n-heptyl, n-octyl, 2-methylheptyl and 2-ethylhexyl radicals; $R_4$ and $R_5$ preferably are alkyl radicals branched in the 2-position.

Exemplary of the foregoing phthalates are di-n-propyl phthalate, diisopropyl phthalate, di-n-butyl phthalate, diisobutyl phthalate, di-(2-ethylhexyl)phthalate and isobutyl 2-ethylhexyl phthalate. Mixtures of these phthalates can obviously also be used.

Aliphatic oils constitute another example of diluents which can be used in the compositions of the invention; the oils obtained by polymerization of butenes, and paraffin oils, are especially adapted for each purpose.

The proportion of the diluent (iii) expressed as a percentage by weight of the total amount of halogenated components, namely, $$\frac{(iii) \times 100}{(i) + (ii)},$$

is calculated such as to effect a significant modification of the following properties of the dielectric composition: permittivity and/or viscosity and/or crystallization point, without thereby prohibitively impairing the non-flammable character of the final composition. Preferably, the maximum amount of diluent is calculated such that the hydrogen index iH of the final mixture, expressed as the weight, in grams per gram of mixture, of hydrogen which can theoretically be liberated by an electric arc, is less than 0.03, preferably less than 0.02. The expression "hydrogen which can theoretically be liberated" connotes that hydrogen originated from the various molecules constituting the final mixture, allowing for the hydrogen consumed in order to form hydrochloric acid and hydrobromic acid with the halogens present in the mixture, during the combustion of the latter.

In fact, if nH and mX are respectively the number of hydrogen atoms and the number of halogen atoms present in P grams of the final mixture, then $iH=(nH-mX)/P$.

As a general rule, the amount of diluent (III) comprises from 3 to 30% by weight of the mixture (i)+(ii), preferably from 5 to 25% by weight.

The dielectric compositions described above can contain the usual adjuvants, such as antioxidants, thickeners for regulating the viscosity of the liquid, for example styrene/butadiene copolymers, and sequestering agents for the hydrochloric acid which can be liberated by decomposition of the chlorobenzenes under the operating conditions of the apparatuses. The sequestering agents used for hydrochloric acid are preferably epoxy compounds, such as those typically employed in chlorinated dielectrics; among such epoxy compounds, the following are exemplary: propylene oxide and glycidyl ethers, styrene oxide 1,3-bis-(2,3-epoxypropoxy)-benzene and di-(2-ethylhexyl)-4,5-epoxytetrahydrophthalate. Other epoxy compounds, such as those referred to in U.S. Pat. Nos. 3,362,708, 3,242,401, 3,242,402, and 3,170,986, can also be used.

The amount of the aforesaid adjuvants incorporated in the dielectric can vary over wide limits. In general, an amount representing from 0.01 to 5% by weight of the dielectric composition is suitable.

The dielectric compositions according to the present invention can be used as insulators for any type of electrical equipment such as transformers, capacitors and circuit breakers, but same are very particularly suitable for transformers.

In order to further illustrate the present invention and the advantages thereof, the following specific examples are given, it being understood that same are intended only as illustrative, and in nowise limitative. In these examples, the flammable nature of the subject compositions was examined by determining the flash point in accordance with ASTM Standard Specification D92-66 and by conducting that test for the flammability of an atomized mist in accordance with ASTM Standard Specification D 3119-75. According to this test, a liquid which sporadically burns, i.e., a liquid which sporadically ignites, but the flames of which are spontaneously extinguished, is considered to be satisfactory. If the mist burns only in the region of the source of the flame (burning at the source), or if it does not burn at all, it is very satisfactory.

EXAMPLES 1 to 17

A series of dielectric compositions was prepared by mixing components, the nature and amounts of which are indicated in the Table I below; the abbreviations which follow denote, respectively:

MBCB: a mixture of monobromochlorobenzenes having the following composition:
para-bromochlorobenzene: 29% by weight
ortho-bromochlorobenzene: 10% by weight
meta-bromochlorobenzene: 61% by weight TTE: a ternary eutectic mixture containing:
1,2,3-trichlorobenzene: 20.3% by weight
1,2,4-trichlorobenzene: 47.3% by weight
1,2,3,4-tetrachlorobenzene: 32.4% by weight DE: a mixture of dichlorobenzene containing:
1,2-dichlorobenzene: 87% by weight
1,4-dichlorobenzene: 13% by weight DM: a mixture of dichlorobenzenes containing:
1,2-dichlorobenzene: 34% by weight
1,3-dichlorobenzene: 27.6% by weight
1,4-dichlorobenzene: 37.9% by weight DMA: a mixture of dichlorobenzenes containing:
1,2-dichlorobenzene: 3.64% by weight
1,3-dichlorobenzene: 56.7% by weight
1,4-dichlorobenzene: 39.2% by weight DMC: a mixture of dichlorobenzenes containing:
1,2-dichlorobenzene: 42.6% by weight
1,3-dichlorobenzene: 39.5% by weight
1,4-dichlorobenzene: 15.1% by weight MTH-10: hydrogenated terphenyl having a degree of hydrogenation of 10% and obtained from a mixture of terphenyls having the following composition:
o-terphenyl: 22% by weight
m-terphenyl: 75% by weight
p-terphenyl: 3% by weight MTH-20: hydrogenated terphenyl having a degree of hydrogenation of 20% and obtained from the same mixture of terphenyls as MTH-10.

IPD-3: isopropylbiphenyl obtained by isopropylating biphenyl and containing 3 isopropyl groups per molecule.

IPMT-1: isopropylterphenyl obtained by isopropylating a mixture of terphenyls which is rich in the meta isomer and has the same composition as that used for the preparation of MTH-10, and containing one isopropyl group per molecule.

PB: polybutene having an average molecular weight of 920 and a viscosity of 235 cSt at 100° C.

PD0: di-(2-ethylhexyl)phthalate, commonly referred to as dioctyl phthalate.

TE: eutectic mixture containing 31% by weight of 1,2,3-trichlorobenzene and 69% by weight of 1,2,4-trichlorobenzene.

BA: benzene alkylated by condensing a propylene tetramer with benzene and having an average molecular weight of 350.

TABLE I

| | COMPONENT | | COMPONENT (ii) | | | | COMPONENT (iii) | |
|---|---|---|---|---|---|---|---|---|
| | | | Nature | | | | | |
| Example | Nature | % of (i) + (ii) | Component a | Component b | % of b/a | % of (i) + (ii) | Nature | % in (i) + (ii) |
| 1 | MBCB | 20 | TTE | none | | 80 | — | |
| 2 | " | 30 | TTE | — | | 70 | — | |
| 3 | " | 30 | TTE | DE | 20 | 70 | — | |
| 4 | " | 20 | TTE | DMC | 20 | 80 | — | |
| 5 | " | 10 | TTE | DMA | " | 90 | — | |
| 6 | " | 20 | " | " | " | 80 | — | |
| 7 | " | " | " | DM | " | " | — | |
| 8 | " | " | " | DE | " | " | MTH-10 | 17.64% |
| 9 | " | " | " | " | " | " | MTH-20 | " |
| 10 | " | " | " | " | " | " | IPD-3 | " |
| 11 | " | " | " | " | " | " | IPMT-1 | " |
| 12 | " | " | " | " | " | " | PB | " |
| 13 | " | " | " | " | " | " | PDO | " |
| 14 | BDCB | 5 | TE | none | — | 95 | none | — |

TABLE I-continued

| | COMPONENT | | COMPONENT (ii) | | | | COMPONENT (iii) | |
|---|---|---|---|---|---|---|---|---|
| | | | Nature | | | | | |
| Example | Nature | % of (i) + (ii) | Component a | Component b | % of b/a | % of (i) + (ii) | Nature | % in (i) + (ii) |
| 15 | MBCB | 15 | TTE | DE | 15 | 85 | MTH-20 | 10% |
| 16 | " | " | " | " | " | " | " | 20% |
| 17 | " | " | " | " | " | " | BA | 10% |

The foregoing compositions have the properties reported in the following Table II:

TABLE II

| Example | Permittivity at 25° C. | Melting point of the last crystals at: °C.(1) | Hydrogen index | Flame resistance ASTM D 3119 | Flash point |
|---|---|---|---|---|---|
| 1 | 5.6 | −18 | −0.0003 | burning at flame source | none up to the boiling point |
| 2 | 5.46 | −23 | +0.001 | burning at flame source | none up to the boiling point |
| 3 | 5.8 | −30 | +0.0035 | burning at flame source | none up to the boiling point |
| 4 | 5.7 | −27 | 0.0023 | burning at flame source | none up to the boiling point |
| 5 | 5.4 | −23 | 0.0013 | burning at flame source | none up to the boiling point |
| 6 | 5.3 | −25 | 0.0023 | burning at flame source | none up to the boiling point |
| 7 | 5.5 | −25 | 0.0023 | burning at flame source | none up to the boiling point |
| 8 | 5.1 | −10 | 0.0138 | intermediate between burning at flame source and sporadic burning | none up to the boiling point |
| 9 | 5.1 | −27 | 0.0151 | intermediate between burning at flame source and sporadic burning | none up to the boiling point |
| 10 | 5.1 | −25 | 0.0194 | sporadic burning | none up to the boiling point |
| 11 | 5.1 | −25 | 0.0160 | intermediate between burning at flame source and sporadic burning | none up to the boiling point |
| 12 | 5 | −22 | 0.0268 | sporadic burning | none up to the boiling point |
| 13 | 5.9 | −25 | 0.0193 | " | none up to the boiling point |
| 14 | 5.8 | 0 | 0.0005 | burning at flame source | none |
| 15 | 6 | −24 | 0.0096 | burning at flame source | none up to the boiling point |
| 16 | 5.6 | −25 | 0.0162 | intermediate between burning at flame source and sporadic burning | none up to the boiling point |
| 17 | 6 | −24 | 0.015 | sporadic burning | none up to the boiling point |

(1)this temperature was determined in the following manner: the mixture was cooled until crystallization was complete, the temperature was then permitted to slowly rise, and the temperature at which the last of the crystals disappeared was recorded.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A liquid, non-flammable dielectric composition, comprising (i) a bromochlorobenzene fraction, and (ii) a polychlorobenzene fraction including a member selected from the group consisting of at least one trichlorobenzene, at least one tetrachlorobenzene, and admixtures thereof.

2. The dielectric composition as defined by claim 1, said bromochlorobenzene fraction (i) comprising at least one bromochlorobenzene having the structural formula:

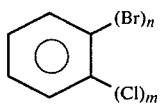

(I)

in which m and n, which are identical or different, are integers equal to 1 or 2, and the sum m+n is no greater than 3.

3. The dielectric composition as defined by claim 2, said at least one bromochlorobenzene being selected from the group consisting of 1-bromo-2-chlorobenzene, 1-bromo-3-chlorobenzene, 1-bromo-4-chlorobenzene, 1,2-dibromo-3-chlorobenzene, 1,2-dibromo-4-chlorobenzene, 1,3-dibromo-2-chlorobenzene, 1,3-dibromo-5-chlorobenzene and 2-bromo-1,3-dichlorobenzene.

4. The dielectric composition as defined by claim 2, said at least one bromochlorobenzene comprising a mixture of 1-bromo-2-chlorobenzene, 1-bromo-3-chlorobenzene and 1-bromo-4-chlorobenzene.

5. The dielectric composition as defined by claim 2, said polychlorobenzene fraction (ii) comprising at least one polychlorobenzene selected from the group consisting of 1,2,3-trichlorobenzene, 1,2,4-trichlorobenzene and 1,2,3,4-tetrachlorobenzene.

6. The dielectric composition as defined by claim 2, said polychlorobenzene fraction (ii) comprising a eutectic mixture of 1,2,3-trichlorobenzene and 1,2,4-trichlorobenzene.

7. The dielectric composition as defined by claim 2, said polychlorobenzene fraction (ii) comprising a ternary eutectic mixture of 1,2,3-trichlorobenzene, 1,2,4-trichlorobenzene and 1,2,3,4-tetrachlorobenzene.

8. The dielectric composition as defined by claim 2, said polychlorobenzene fraction (ii) further comprising at least one dichlorobenzene.

9. The dielectric composition as defined by claim 8, said at least one dichlorobenzene being selected from the group consisting of 1,2-dichlorobenzene, 1,3-dichlorobenzene, 1,4-dichlorobenzene, and admixtures thereof.

10. The dielectric composition as defined by claim 8, said at least one dichlorobenzene comprising from about 2 to 25% by weight of said polychlorobenzene fraction.

11. The dielectric composition as defined by claim 2, said bromochlorobenzene fraction (i) comprising from about 5 to 35% by weight thereof, and said polychlorobenzene fraction (ii) from about 95 to 65% by weight thereof.

12. The dielectric composition as defined by claims 1 or 10, further comprising a diluent (iii) selected from the group consisting of biphenyl, monoalkylbiphenyl, polyalkylbiphenyl, terphenyl, monoalkylterphenyl, polyalkylterphenyl, at least partially hydrogenated biphenyl, at least partially hydrogenated terphenyl, monoalkylbenzene, polyalkylbenzene, diphenyl- and polyphenylalkanes wherein the aliphatic radical contains from about 1 to 10 carbon atoms, phthalate, and natural or synthetic aliphatic oil.

13. The dielectric composition as defined by claim 12, said diluent (iii) comprising an alkylbiphenyl having the structural formula:

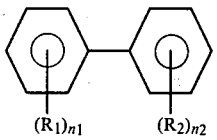

(II)

in which $R_1$ and $R_2$ represent linear or branched chain alkyl radicals which are identical or different and contain from 1 to 5 carbon atoms, and $n_1$ and $n_2$, which are identical or different, represent 0 or an integer ranging from 1 to 3, with the proviso that at least one of the indices $n_1$ and $n_2$ is equal to at least 1 and that the sum $n_1+n_2$ is no greater than 5.

14. The dielectric composition as defined by claim 12, said diluent (iii) comprising an alkylterphenyl having the structural formula:

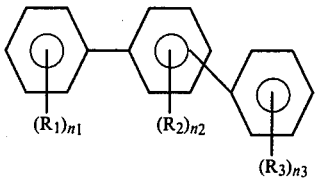

(III)

in which $R_1$, $R_2$ and $R_3$ represent linear or branched chain alkyl radicals which are identical or different and contain from 1 to 5 carbon atoms, and $n_1$, $n_2$ and $n_3$, which are identical or different, represent 0 or an integer ranging from 1 to 3, with the proviso that at least one of the indices $n_1$, $n_2$ and $n_3$ is equal to at least 1 and that the sum $n_1+n_2+n_3$ is no greater than 4.

15. The dielectric composition as defined by claim 13, the diluent (iii) comprising an admixture of such alkylbiphenyls.

16. The dielectric composition as defined by claim 14, the diluent (iii) comprising an admixture of such alkylterphenyls.

17. The dielectric composition as defined by claim 12, the diluent (iii) comprising biphenyl, per se.

18. The dielectric composition as defined by claim 12, the diluent (iii) comprising terphenyl, per se.

19. The dielectric composition as defined by claim 15, the degree of alkylation of the admixture comprising the diluent (iii), expressed as the number of alkyl groups per molecule of biphenyl, being at least 0.5.

20. The dielectric composition as defined by claim 16, the degree of alkylation of the admixture comprising the diluent (iii), expressed as the number of alkyl groups per molecule of terphenyl, being at least 0.5.

21. The dielectric composition as defined by claim 13, $R_1$ and $R_2$ being selected from the group consisting of methyl, ethyl, n-propyl, isopropyl, n-butyl, isobutyl, sec.-butyl, and t-butyl.

22. The dielectric composition as defined by claim 14, $R_1$, $R_2$ and $R_3$ being selected from the group consisting of methyl, ethyl, n-propyl, isopropyl, n-butyl, isobutyl, sec.-butyl and t-butyl.

23. The dielectric composition as defined by claim 12, said diluent (iii) comprising at least partially hydrogenated biphenyl having a degree of hydrogenation of at least 10%.

24. The dielectric composition as defined by claim 12, said diluent (iii) comprising at least partially hydrogenated terphenyl having a degree of hydrogenation of at least 10%.

25. The dielectric composition as defined by claim 12, said diluent (iii) comprising a phthalate having the structural formula:

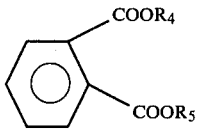

(IV)

in which $R_4$ and $R_5$, which are identical or different, represent linear or branched chain alkyl radicals having from 3 to 10 carbon atoms.

26. The dielectric composition as defined by claim 25, both $R_4$ and $R_5$ being branched in the 2-position.

27. The dielectric composition as defined by claim 26, said phthalate being di(2-ethylhexyl)phthalate.

28. The dielectric composition as defined by claim 12, said diluent (iii) comprising polybutene.

29. The dielectric composition as defined by claim 12, said diluent (iii) comprising a paraffin oil.

30. The dielectric composition as defined by claim 12, having a hydrogen index iH of less than 0.003.

31. The dielectric composition as defined by claim 12, said diluent (iii) comprising up to 30% by weight of the total weight of the fractions (i) and (ii).

32. The dielectric composition as defined by claim 31, said diluent (iii) comprising at least 3% by weight of the total weight of the fractions (i) and (ii).

33. The dielectric composition as defined by claim 12, further comprising a sequestering agent.

34. The dielectric composition as defined by claim 33, wherein the sequestering agent is an epoxy compound.

35. The dielectric composition as defined by claim 34, wherein the epoxy compound is a compound selected from the group consisting of propylene oxide, glycidyl ethers, styrene oxide, 1,3-bis-(2,3-epoxy-propoxy)-benzene and di(2-ethylhexyl)-4,5-epoxy-tetrahydrophthalate.

36. In a transformer, the improvement which comprises insulation/coolant material comprising the dielectric composition as defined by claim 12.

* * * * *